United States Patent [19]

Gloppen et al.

[11] Patent Number: 4,612,751

[45] Date of Patent: Sep. 23, 1986

[54] DAPPED END REINFORCEMENT ASSEMBLY FOR PRECAST PRESTRESSED CONCRETE MEMBERS

[75] Inventors: Edward C. Gloppen, Elk Grove Village; Norman L. Scott, Glenview, both of Ill.

[73] Assignee: Dur-O-Wal, Inc., Arlington Heights, Ill.

[21] Appl. No.: 753,159

[22] Filed: Jul. 9, 1985

[51] Int. Cl.[4] ..... E04C 3/20

[52] U.S. Cl. ..... 52/723; 52/250; 52/602; 52/340

[58] Field of Search ..... 52/733, 283, 630, 340, 52/602, 250, 723

[56] References Cited

U.S. PATENT DOCUMENTS

| | | | |
|---|---|---|---|
| 3,465,484 | 9/1969 | Zaldastani et al. | 52/250 |
| 3,604,177 | 9/1971 | Clyne et al. | 52/250 |
| 3,800,491 | 4/1974 | Gunia | 52/602 |
| 3,851,024 | 11/1974 | Cull et al. | 52/340 |

*Primary Examiner*—William F. Pate, III
*Assistant Examiner*—Caroline D. Dennison
*Attorney, Agent, or Firm*—Jenner & Block

[57] ABSTRACT

A reinforcing structure for precast concrete is provided. The reinforcing structure includes a horizontally disposed bearing plate, and a vertically oriented planar reinforcing mesh extending above, below and inboard of the bearing plate. A vertical reaction bar is connected to the vertically oriented reinforcing mesh at a horizontal position inboard of the bearing plate. A horizontal reinforcing bar is oriented parallel to the vertically oriented planar reinforcing mesh.

3 Claims, 4 Drawing Figures

DAPPED END REINFORCEMENT ASSEMBLY FOR PRECAST PRESTRESSED CONCRETE MEMBERS

BACKGROUND OF THE INVENTION

Modern civil construction makes extensive use of prestressed, precast concrete beams. In many regions of the United States, parking garages and other buildings can be quickly, economically and profitably constructed using precast, prestressed beam members. Double tee beam shapes are widely used; typically, these members can have a top flange width of 8 to 10 feet, a total flange-and-web depth of up to 48 inches, and a length of 60 feet.

To reduce floor-to-floor building height without losing necessary strength in the structural beam members, the web ends of these tees or double tee members can be provided with "daps." A "dap" design provides a recess in the lower corners of the beam web. When the beam is installed in the building, this recess or notch mates with a haunch, pilaster or other supporting structure, and the mating arrangement accordingly reduces the floor-to-floor height of the building. Proper steel reinforcement of the dapped beam ends is important.

At present, significant quantities of these precast, prestressed concrete members are manufactured by specialized manufacturing or precasting companies, and the finished beams are sold to the building construction contractor on an as-needed, where-needed basis. But the precasters are required to assemble and weld their own steel reinforcing systems for the beams and other members they are casting. The proper and economical fabrication of the dap reinforcing structures can be particularly difficult, time consuming and expensive. Economies of scale and mass production are only minimally available to the precaster who manufactures his own reinforcing assemblies. And if special steel rod sizes or other steel shapes are found to be desirable from a design standpoint, the manufacture and purchase of such special shapes can be prohibitively expensive if only a few are needed.

It is accordingly a general object of the invention to offer a standardized dapped end reinforcing steel assembly especially designed for precast, prestressed concrete beam members.

A related object is to provide such assemblies which can be manufactured and offered to precasting companies at an attractive price.

To accomplish these objects, a steel reinforcing assembly, especially adapted for effective use with dapped beam ends, is provided. The reinforcing assembly includes a horizontally disposed bearing plate, and a vertically oriented planar reinforcing mesh extending above, below and inboard of the bearing plate. The vertical reaction bar is connected to the vertically oriented reinforcing mesh at a horizontal position inboard of the bearing plate. A horizontal reinforcing bar is oriented parallel to but is spaced from the vertically oriented planar reinforcing mesh.

Other objects, advantages and aspects of the invention will become apparent upon reading the following detailed description and upon reference through the drawings. Throughout the drawings, like reference numerals refer to like parts.

DETAILED DESCRIPTION OF THE DRAWINGS

DETAILED DESCRIPTION

While the invention will be described in connection with a preferred embodiment and procedure, it will be understood that it is not intended that the invention be limited to this embodiment. On the contrary, it is intended to cover all alternatives and modifications as may be included within the spirit and scope of the invention as defined by the appended claims.

Figure 1:
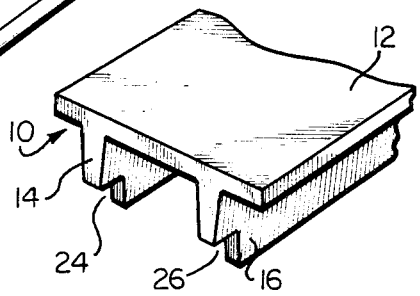
FIG. 1 is a perspective fragmentary view showing a typical double tee precast, prestressed concrete construction member having dapped web ends.

Turning first to FIG. 1, there is shown a typical double tee precast, prestressed concrete construction member 10. In general, this double tee member 10 can be considered to include an upper flange 12, and two depending webs 14, 16. Typically, this double tee member 10 can have a length of 35 to 60 feet or more. The common upper flange 12 can be up to 10 feet wide, and a typical overall vertical height or depth of the double tee unit is 24 inches.

In building a multi-story parking garage or office building, the beams are often mounted upon haunches, pilasters, or other columnar support members. To reduce the overall height of the structure, it has been found safe and useful to form each web 14, 16 with a notch or dap formation 24, 26.

The novel steel structure 30 reinforces the structure around the dap relief 24. In general, this steel reinforcement structure 30 can be understood to include a horizontally disposed bearing plate 32, and a vertically oriented planar reinforcing sub-assembly 33, connected to and extending above, below and inboard of the plate 32. A vertical reaction bar 34 is connected to the reinforcing assembly 33 at a horizontal position inboard of the bearing plate 32, as especially suggested in FIG. 4. A horizontal reinforcing bar 36 can be connected to the plate 32.

More particularly, the planar reinforcing assembly 33 comprises an open mesh of interconnected wire or bar members 37, 38. The precise number of these vertical and horizontal bars or wires 37, 38, and their precise size and spacing can be calculated by consulting the Prestressed Concrete Institute Design Handbook, Third Edition (1985, published by Prestressed Concrete Institute, 201 N. Wells, Chicago, Ill. 60606). The wire or bar elements 37, 38 are induction welded to one another to provide a strong, rigid assembly which will properly take up and distribute the various vertical shear and other forces applied to the finished precast concrete beam in which the dap reinforcing structure is located.

Figure 2:
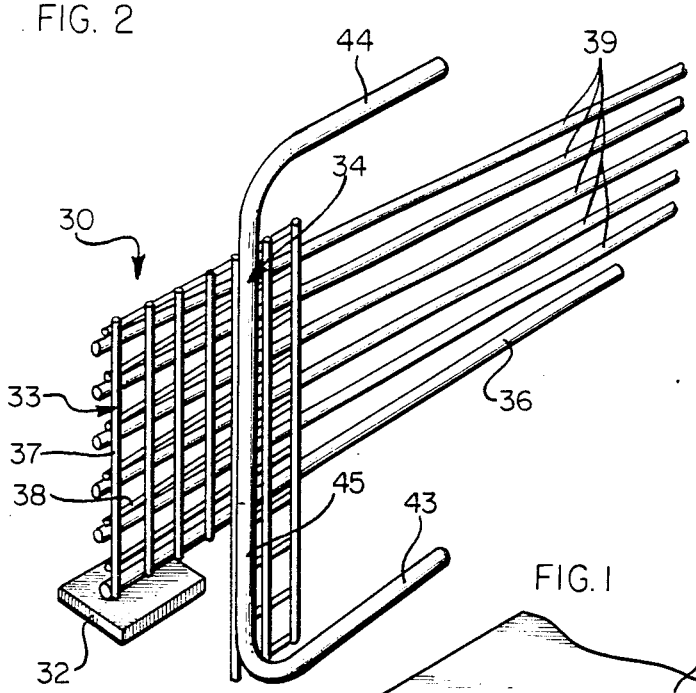
FIG. 2 is a perspective view of a novel reinforcing steel assembly used in connection with a dapped web end of the double beam tee member shown in FIG. 1.
Figure 4:
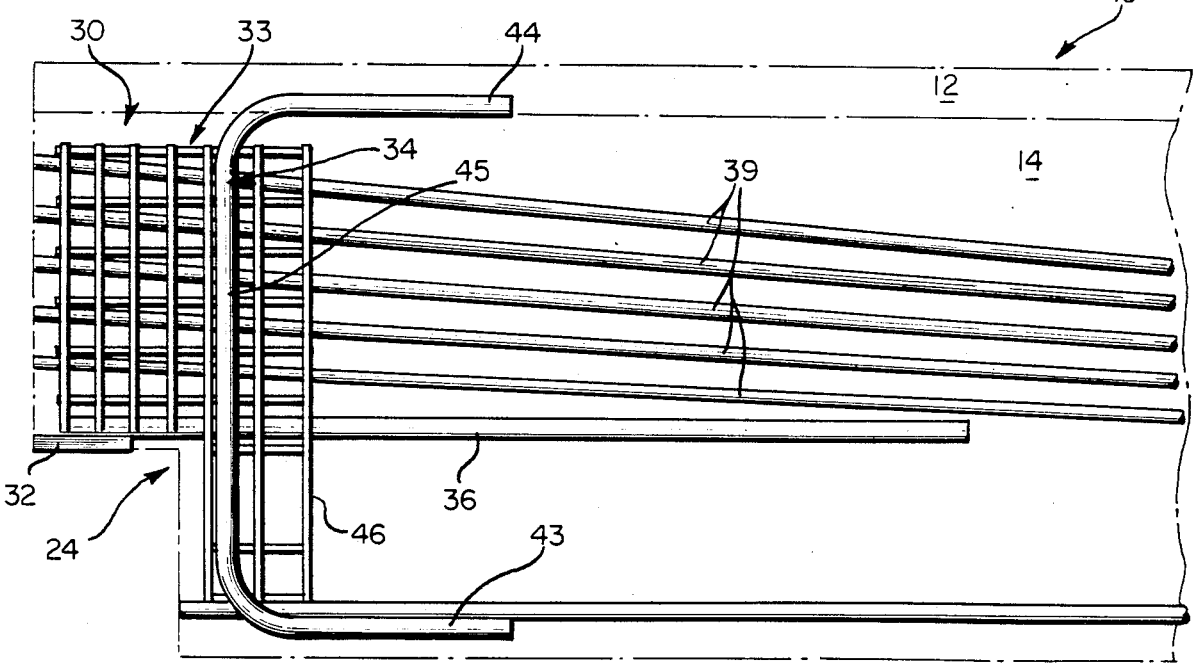
FIG. 4 is a side elevational view of the reinforcing steel assembly and the flange and web of the precast, prestressed concrete member shown in FIGS. 1 and 3.

If desired, the horizontal wires or bars 38 can be custom spaced to permit straight or draped reinforcing strands 39 to pass between the adjacent vertical elements 38 as particularly suggested in FIGS. 2 and 4.

Figure 3:
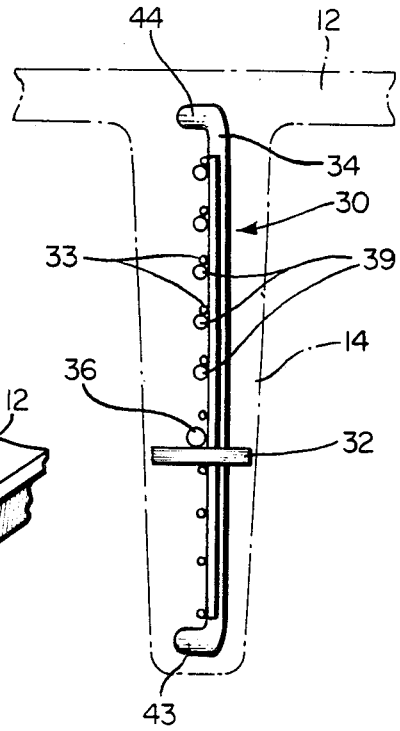
FIG. 3 is an end elevational view of the reinforcing assembly of FIG. 2 as it is emplaced and used in the web of a precast, prestressed concrete beam member of the type shown in FIG. 1.

The pre-stressing strands 39 can pass through and adjacent to the wires 37 and 38 of the mesh 33 without violating building code requirements for concrete cover, as especially suggested in FIG. 3.

To further resist shear forces in the area of the dap relief 24, a relatively large and longitudinally disposed reinforcing bar 36 is welded to the plate 32. The size and length of this horizontally disposed bar 36, which is sometimes referred to as an "A bar," can be determined by using the Prestressed Concrete Institute Design Handbook mentioned above, and by designing the bar to meet current American Concrete Institute Standard 318 requirements. This longitudinal reinforcing bar 36 is oriented parallel to the vertically oriented planar reinforcing mesh elements 33, as particularly suggested in FIG. 3. In the illustrated embodiment, the bar 36 is line welded to the bearing plate 32.

The vertical reaction bar 34 is provided with ends 43, 44 which are bent or turned so as to extend in a horizontally inboard direction to provide further vertical shear reinforcement, as particularly illustrated in FIGS. 2 and 4. To further develop strength in the beam 10, the reaction bar end portions 43, 44 each extend horizontally from one side of the mesh 33 across the mesh 33 to points on the opposite sides of the mesh 33, as particularly suggested in FIG. 3. To fit the pre-assembled structure conveniently into the precast concrete form and yet develop the desired reinforcement, the vertical reaction bar hooked ends 43, 44 may extend beyond the inboard edge 46 of the vertical reinforcing mesh 33. If desired, the necessary concrete/steel reaction bar bond can be developed by substituting plates or other anchors of appropriate shape for these ends 43, 44.

The vertical reaction bar 34 may have an effective cross-sectional area exceeding 0.40 square inches to provide the desired strength. Bars of such great cross-sectional area may require special fabrication. Alternatively, two or more bars may be provided. Tie spacers of known variety (not shown) interconnect the vertically oriented or mediate portion 45 of the vertically oriented reinforcing bar 34 to the mesh 33.

In use, the parts of the described reinforcing assembly 30 are first fabricated to the precaster's dimensional specifications. The dap relief or dropout 24 in the mesh 33 can be long or short, shallow or deep. The horizontal reinforcement bar 36 is welded to the bearing plate 32. At a position spaced from the bar 34, the plate 32 is welded to the vertical web wires 37 of the reinforcing mesh 33, and the vertical reaction bar 34 is attached to the mesh 33 as described above. Tie spacer means of known construction can be used to further interconnect the various parts of the assembly. When the entire reaction reinforcing assembly is completed, it is shipped or delivered to the concrete pre-caster. The assembly is then installed in its proper position within a pre-cast concrete form, and the reinforcing wires 39 are attached within the form and, if desired, to the assembly 30. If desired, the assembly 30 can be secured to the inside of the precasting form to prevent assembly movement when the concrete is poured into the form. The concrete is then poured into the form and allowed to harden in known manner. Thereafter, the completed pre-cast concrete element is removed from the form and shipped to the job site for installation in the building structure.

What is claimed is:

1. A reinforcing structure for a concrete dap beam end, the structure comprising a horizontally disposed bearing plate located at a dap bearing surface, a vertically oriented planar reinforcing means comprising an open mesh of interconnected rod members of relatively small cross-sectional dimensions, the reinforcing mesh extending above and inboard of the dap formation, a vertical reaction bar means connected to the vertically oriented reinforcing means and having a vertically oriented mediate portion of relatively large cross-sectional dimensions situated on one side of the vertically oriented planar reinforcing means, and horizontally oriented reaction bar end portions extending horizontally from the mediate portion across the width of the vertically oriented planar reinforcing means to points on the opposite sides of the vertically oriented planar reinforcing means, and longitudinally disposed reinforcing bar means of relatively large cross-sectional dimensions oriented parallel to but spaced horizontally apart from said vertically oriented planar reinforcing means.

2. A reinforced concrete member comprising a flange portion and a web portion extending normally from the flange portion, at least one end of the web portion defining a dap relief having, in use, a substantial bearing surface, and reinforcing structure disposed substantially within the web portion, the reinforcing structure including a horizontally disposed bearing plate located substantially at the dap bearing surface, a vertically oriented planar reinforcing means comprising an open mesh of interconnected rod members of relatively small cross-sectional dimensions, the reinforcing means extending above, below and inboard of the bearing plate, vertical reaction bar means connected to the vertically oriented reinforcing mesh means at a horizontal position inboard of the bearing plate the vertical reaction bar means having a vertically oriented mediate portion of relatively large cross-sectional dimensions situated on one side of the vertically oriented planar reinforcing means, and horizontally oriented reaction bar end portions extending horizontally from the mediate portion across the width of the vertically oriented planar reinforcing means to points on the opposite side of the vertically oriented planar reinforcing means, the reinforcing structure further including a horizontal reinforcing bar of relatively large cross-sectional dimensions extending horizontally inboard from the bearing plate at a location spaced horizontally apart from the vertically oriented planar reinforcing means.

3. The combination of claims 1 or 2 wherein said vertical reaction bar means has an effective cross-sectional area exceeding 0.40 square inches.

* * * * *